United States Patent [19]

Norris

[11] Patent Number: 5,056,266

[45] Date of Patent: Oct. 15, 1991

[54] ROTARY BRAKE ROTOR RESURFACER

[76] Inventor: Bobby D. Norris, 2 Bryce Ct., Fletcher, N.C. 28732

[21] Appl. No.: 461,012

[22] Filed: Jan. 4, 1990

[51] Int. Cl.[5] ..... B24B 7/00

[52] U.S. Cl. ..... 51/111 R; 51/117; 51/118; 51/132

[58] Field of Search ..... 51/117, 118, 111 R, 51/132, 106, 134.5, 281 R, 281 SF

[56] References Cited

U.S. PATENT DOCUMENTS

| | | | |
|---|---|---|---|
| 3,182,428 | 5/1965 | Hannon | 51/118 |
| 3,653,160 | 4/1972 | Raickle | 51/111 |
| 3,992,820 | 11/1976 | Suter | 51/118 |
| 4,361,988 | 12/1982 | Gramlich | 51/132 |
| 4,713,952 | 12/1987 | Senger et al. | 51/332 |
| 4,827,677 | 5/1989 | Schmitz | 51/118 |

*Primary Examiner*—Frederick R. Schmidt
*Assistant Examiner*—Mark A. Morris
*Attorney, Agent, or Firm*—W. Thad Adams, III

[57] ABSTRACT

A rotary brake resurfacer includes a first electric motor, a geared motor speed reducer operatively associated with the first motor for outputting a reduced rotational speed and a driven shaft mounted for rotation at the reduced output speed of the speed reducer. A brake rotor to be resurfaced is mounted on the driven shaft. A second electric motor is provided and a grinder shaft is mounted for being rotated by the second electric motor. First and second grinding stones are rotatably mounted in spaced-apart relation on the grinder shaft and the griding stones are moved into contact with the braking surface of the rotating brake rotor for resurfacing the braking surface of the brake rotor. The method according to the invention includes the steps of rotating a brake rotor, rotating at least one grinding stone and engaging the rotating grinding stone with the braking surface of the rotating brake rotor for resurfacing the braking surface of the brake rotor.

7 Claims, 2 Drawing Sheets

ROTARY BRAKE ROTOR RESURFACER

TECHNICAL FIELD AND BACKGROUND OF THE INVENTION

This invention relates to a rotary brake rotor resurfacer. The invention is characterized by utilizing rotating grinding stones to resurface the braking surface of a disc brake rotor.

Prior art devices utilize a lathe-type arrangement wherein a cutter blade or blades is moved radially along the braking surface to cut off a thin layer of the braking surface and expose a smooth, renewed braking surface. Lathes manufactured by Rels Manufacturing and Accut-turn operate according to this principle. These lathes are quite expensive and require careful adjustment. Even a slight misadjustment of the cutter head can cause damage to the braking surface of the rotor. Furthermore, the extreme pressure created by engaging the very small surface area of the cutter head against the braking surface requires very heavy duty ways and bracing.

The invention according to this invention uses a completely different principle. Instead of cutting off a thin layer of the braking surface, the apparatus according to the invention grinds, in effect "polishes" off the worn surface as both the brake rotor and the grinding stones rotate relative to each other. By engaging a relatively large surface of the grinding stones with the braking surface of the brake rotor, a much more precise, flat and polished surface can be obtained in less time and without possibility of damage to the braking surface.

SUMMARY OF THE INVENTION

Therefore, it is an object of the invention to provide a rotary brake rotor resurfacer.

It is another object of the invention to provide a rotary brake rotor resurfacer which resurfaces the brake rotor by grinding and polishing the brake surface, rather than by cutting the braking surface on a lathe.

It is another object of the invention to provide a rotary brake rotor resurfacer which resurfaces both opposing brake surfaces without having to reposition the brake rotor.

It is another object of the invention to provide a rotary brake rotor resurfacer which automatically grinds the obverse surfaces of the brake rotor parallel each other.

These and other objects of the present invention are achieved in the preferred embodiments disclosed below by providing a brake rotor resurfacer for resurfacing the braking surface of a brake rotor. The brake resurfacer comprises a brake rotor rotating means for rotating a brake rotor and grinder rotating means for rotating at least one rotatably-mounted grinding stone. Engagement means selectively move the rotating grinding stone against the braking surface of the rotating brake rotor for resurfacing the braking surface of the brake rotor.

According to one preferred embodiment of the invention, the rotating means for rotating a brake rotor comprises a first electric motor, a shaft driven by the motor and locking means for locking a brake rotor on the shaft for rotation on the shaft.

According to another preferred embodiment of the invention, the first electric motor includes speed reducing means for reducing the speed of the shaft driven by the motor to the range of 20 to fifty rpm.

According to yet another preferred embodiment of the invention, first and second spaced-apart grinding stones are adapted to be positioned on opposite sides of a brake rotor mounted on the rotating means for successive, engagement with opposing braking surfaces of the braking surface of the brake rotor.

Preferably, the grinder rotating means rotate the grinding stones at between 1700 and 3500 rpm.

Preferably, the first and second grinding stones are concentrically mounted on a single rotating grinding stone shaft.

According to one preferred embodiment of the invention, the brake resurfacer includes a compound slide table for mounting the first and second grinding stones for adjustable movement of the first and second grinding stones radially in relation to the axis or rotation of the brake rotor and for axial movement of the grinding stones successively into engagement with opposing sides of the brake rotor.

According to another preferred embodiment of the invention, a rotary brake resurfacer comprises a first electric motor, a geared motor speed reducer operatively associated with the first motor for outputting a reduced rotational speed and a driven shaft mounted for rotation at the reduced output speed of the speed reducer. Means are provided for mounting a brake rotor to be resurfaced on the driven shaft. The invention also includes a second electric motor, a grinder shaft mounted for being rotated by the second electric motor, first and second grinding stones rotatably mounted in spaced-apart relation on the grinder shaft and means for moving the grinding stones into contact with the braking surface of the rotating brake rotor for resurfacing the braking surface of the brake rotor.

An embodiment of the method according to the invention comprises the steps of rotating a brake rotor, rotating at least one grinding stone and engaging the rotating grinding stone with the braking surface of the rotating brake rotor for resurfacing the braking surface of the brake rotor.

According to one preferred embodiment of the invention, the step of rotating at least one grinding stone comprises rotating first and second concentrically mounted and spaced-apart grinding stones.

According to another preferred embodiment of the invention, the method includes the steps of positioning the brake rotor between the first and second grinding stones, engaging a first braking surface of the brake rotor with the first grinding stone to resurface the first braking surface and engaging a second braking surface of the brake rotor obverse to the first braking surface of the brake rotor with the second grinding stone to resurface the second braking surface

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
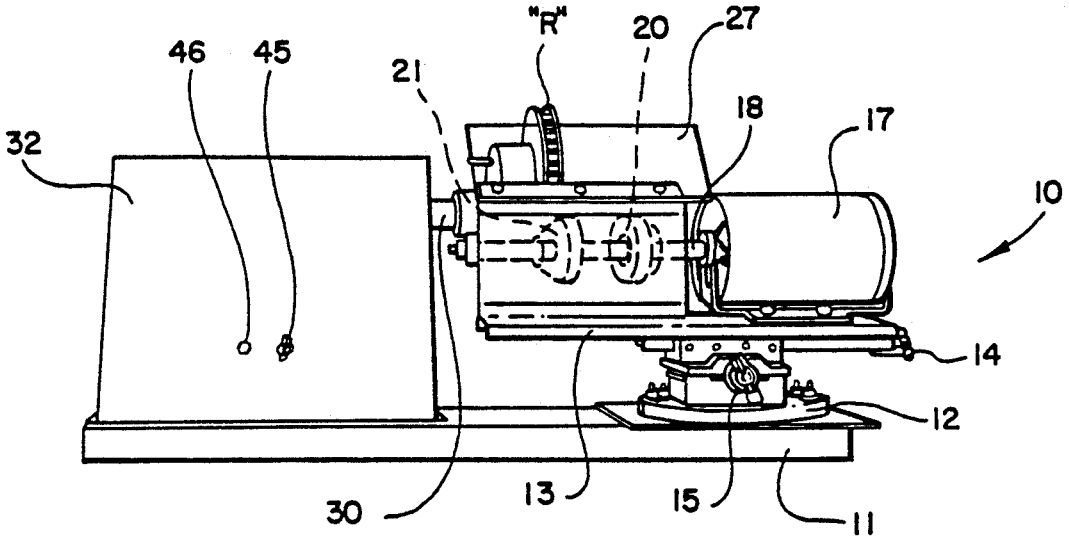
FIG. 1 is a front elevation view of the brake resurfacer according to an embodiment of the invention with parts broken away for clarity.

Referring now specifically to the drawings, a rotary brake resurfacer according to the present invention is illustrated in FIG. 1 and shown generally at reference numeral 10. The resurfacer 10 is preferably mounted on a stand 11 which may be moveable on wheels (not shown) A base 12 having a compound slide mechanism is fixed by bolts or otherwise to stand 11. The compound slide includes an elongate table 13 which is movable in a direction both along and perpendicular to the longitudinal axis of table 13. Movement along the axis of the table 13, referred to as "horizontal adjustment" is controlled by a hand crank 14 positioned on the end of table 13. Lateral movement of the table 13 perpendicular to the axis of the table 13, referred to as "depth adjustment" is controlled by hand crank 15 on the front of table 13. An electric motor 17 is mounted by mounting bolts on table 13 and rotates a shaft 18 on which are mounted two spaced-apart grinding stones 20 and 21.

Figure 2:
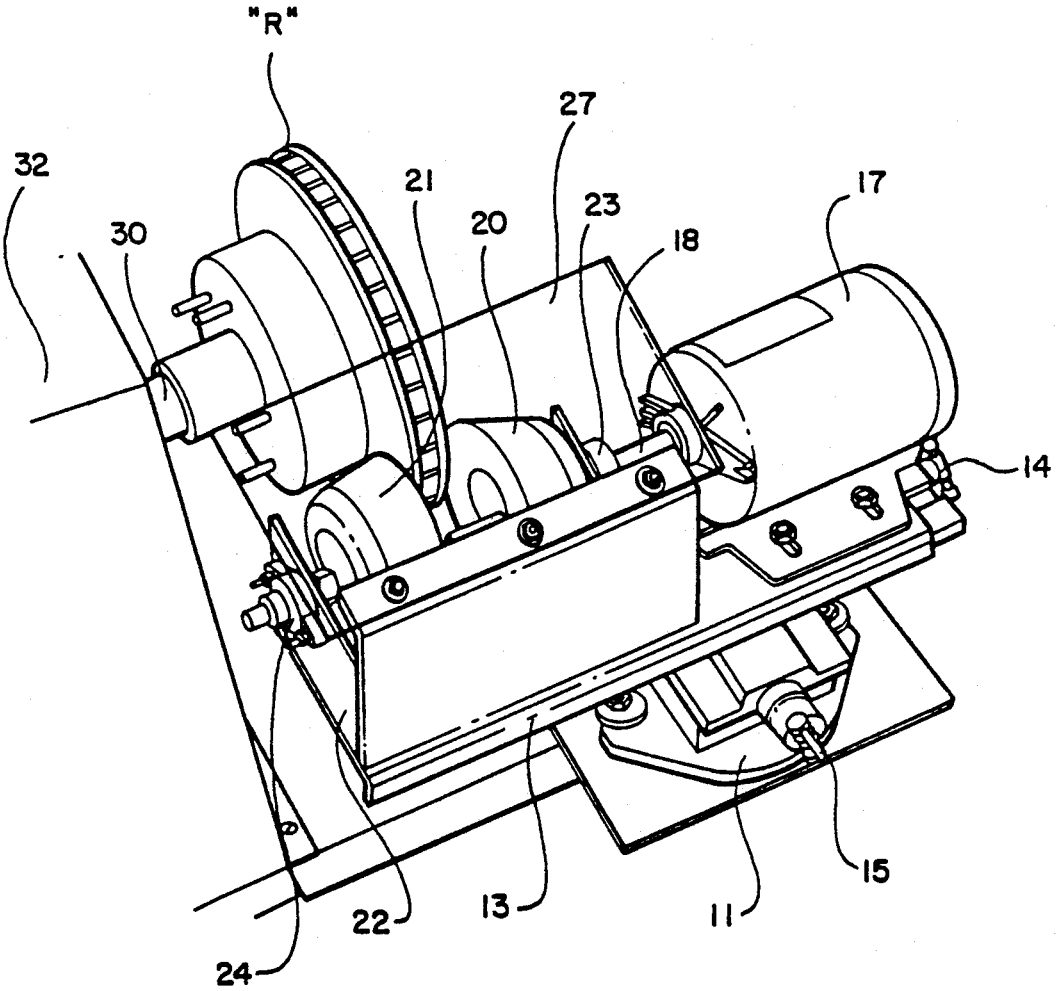
FIG. 2 is a rear view of the brake resurfacer shown in FIG. 1.

As is best shown in FIG. 2, grinding stones 20, 21 reside within a partial grinding enclosure 22. The opposing sides of the enclosure 22 support shaft bearings 23 and 24 in which shaft 18 is mounted and supported for rotation. A transparent safety guard 27 is mounted on the front of the grinding enclosure 22. Grinding stones 20 and 21 are threaded onto shaft 18 and locked in place with locking nuts, and therefore rotate with shaft 18. Motor 17 is a General Electric model 5KH37NN85 1/3 horsepower constant speed motor rotating at 1725 rpm. However, motors having different rotating speeds and powers can also be used, depending upon the type of grinding stones 20, 21 used.

The grinding stones 20, 21 are preferably spaced about 2.5" apart on shaft 18. In the embodiment shown in the drawings, the grinding stones 20, 21 are Bancroft "A" shape Type 2 grinding stones ordinarily used for hand-grinding metal components, but many other types of stones may also be used. Generally, the rougher the stones used, the faster the motor turning the stones should rotate. The grinding stones 20, 21 are mounted with the flat grinding faces opposing each other. The space between the grinding stones 20, 21 permits the braking surface portion of a brake rotor to be positioned between stones 20, 21.

Figure 3:
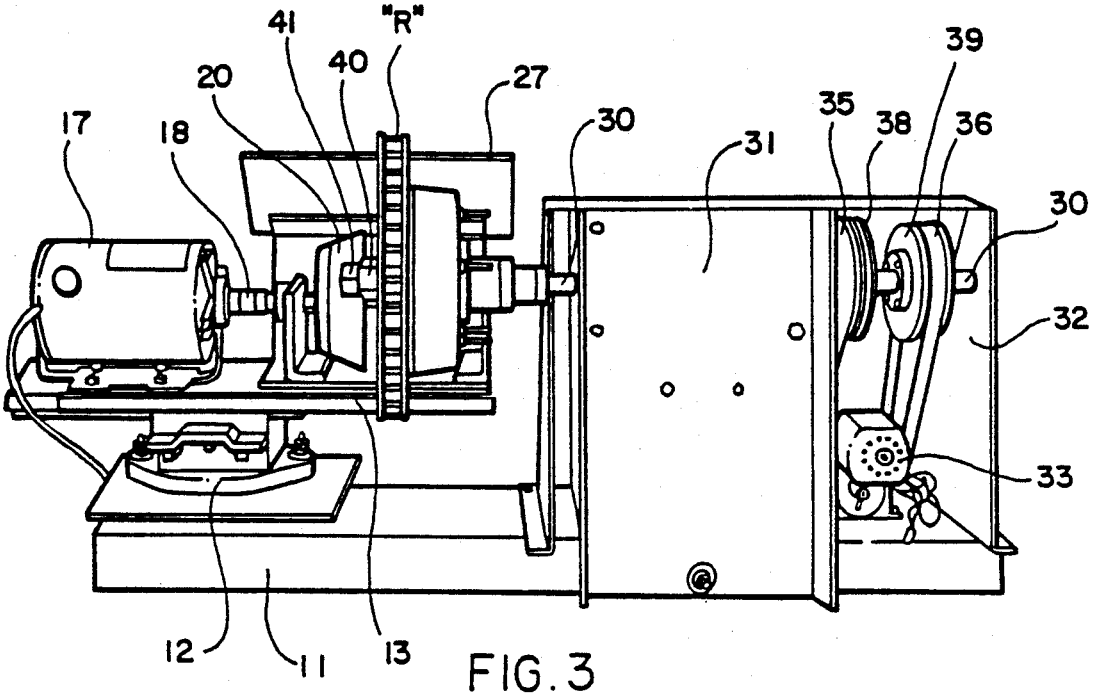
FIG. 3 is a perspective view of the resurfacer shown in FIG. 1.

Referring now to FIG. 3, the rotor is mounted on an arbor 30 which is supported by a pair of spaced-apart shaft bearings (not shown) mounted to the face of an arbor support 31 positioned within housing 32. A gear reducer motor 33 is mounted within the housing 32. Gear reducer motor 33 is preferably a Dayton Model No. 228018, 1/15 horsepower gear reducer motor which outputs 20 rpm. Power is transmitted from motor 33 to arbor 30 by a pair of drive belts 35, 36 which are driven by the motor 33 and which drive a pair of shaft pulleys 38, 39. The two pulleys 38, 39 are used in order to provide greater power transfer from motor 33 to arbor 30. A brake rotor "R" is mounted on arbor 30 by placing the end of arbor 30 through the central bore of the rotor "R". An enlarged stop on arbor 30 (not shown) fixes the plane of rotation of the rotor, and a pair of locking nuts 40, 41 lock the rotor onto arbor 30 in the fixed plane of rotation. The rotor rotates with the arbor 30 in a fixed plane.

In operation, the braking surface of the rotor is renewed by locking the rotor onto the arbor 30, as described above. The rotor resides in the space between grinding stones 20, 21. Hand crank 14 is turned to position both grinding stones 20, 21 in spacedapart relation to the opposing braking surfaces of the rotor.

Figure 4:
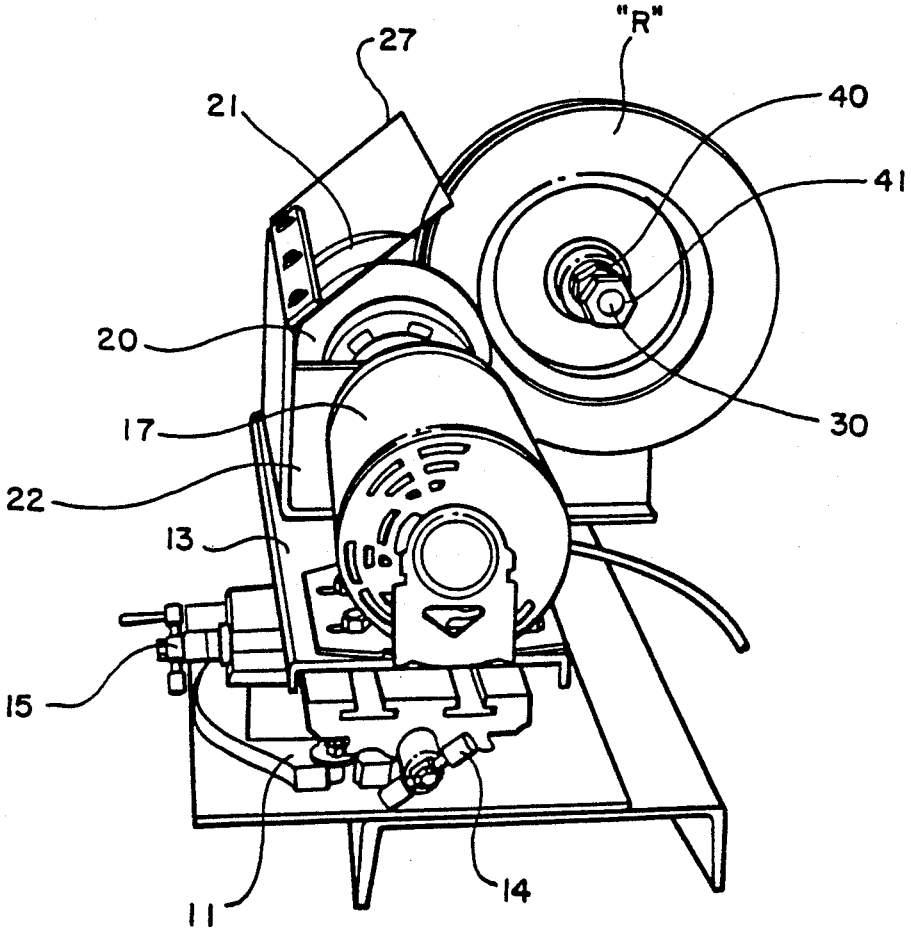
FIG. 4 is an end view of the brake resurfacer showing the relationship between the rotor and the grinding stones.

Hand crank 15 is rotated to adjust the depth of the grinding stones 20, 21 to insure that the stones grind only the braking surface of the rotor. See FIG. 4. This adjustment is necessary since rotors of various sizes can be resurfaced.

After the grinding stones 20, 21 have been adjusted to the size of the rotor, motor 33 is switched on with switch 45 on the front of housing 32. The rotor rotates at 20 rpm. Motor 17 is switched on with switch 46 on the front of housing 32. After the grinding stones 20, 21 have reached full speed, hand crank 14 is used to vary the horizontal adjustment of the grinding stones 20, 21 and thereby bring one of the stones at a time into contact with a respective braking surface of the rotor. This procedure is shown in FIG. 2. Hand crank 14 is calipered and permits the operator to move the grinding stones 20 and 21 a predetermined distance into the face of the rotor, thereby removing only the minimum amount of the outer layer of the braking surface which is necessary. After one face of the rotor has been resurfaced, the hand crank 14 is rotated in the opposite direction, and the other one of the grinding stones 20, 21 is brought into contact with the obverse braking surface.

In contrast to the operation of a brake resurfacing lathe, the invention according to this application does not cut the braking surface and does not remove the worn surface by making fine grooves in the metal surface. Rather, the operation is more akin to polishing the surface down to a renewed surface. Furthermore, the simultaneous rotation of both the grinding stones 20, 21 and the rotor subjects the braking surface to grinding action from every direction. Any minute variations in the surface of the rotor of the grinding stones are fully compensated for, leaving a very flat, uniform surface one each braking surface. Since the rotor and the grinding stones 20, 21 rotate on the exact same axis during the grinding of both braking surfaces, the braking surfaces after resurfacing are in exactly the same plane.

Grinding stones 20, 21 engage a relatively large surface area of the rotor at any given time. For this reason, stress on the rotor is less than when resurfacing is done with a lathe, and there is virtually no chance of accidentally gouging the braking surface, as can happen with a cutter head on a lathe. The finish on the renewed braking surface is very uniform, since variations caused by cutter head wear is eliminated.

A resurfacer for disc brake rotors is described above. Various details of the invention may be changed without departing from its scope. Furthermore, the foregoing description of the preferred embodiment of the invention and the best mode for practicing the invention are provided for the purpose of illustration only and not for the purpose of limitation-the invention being defined by the claims.

I claim:

1. A brake rotor resurfacer for resurfacing opposed braking surfaces of a vehicle brake rotor while the brake rotor is demounted from the vehicle, comprising:

(a) brake rotor rotating means for rotating a brake rotor;

(b) a grinder rotating means comprising a common shaft;

(c) first and second coaxial and rotatably-mounted grinding stones mounted on the common shaft in a fixed and parallel plane of rotation relative to the plane of rotation of said brake rotor;

(d) locking means for locking the first and second grinding stones on the grinder rotating means at a distance apart from each other greater than the axial thickness of the brake rotor to be resurfaced;

(e) engagement means for selectively moving the first grinding stone against the first braking surface of said rotating brake rotor for resurfacing the first braking surface of said brake rotor while said second grinding stones is spaced apart from the second braking surface of the brake rotor, and for thereafter selectively moving the second grinding stone against the second braking surface of said rotating brake rotor for resurfacing the second braking surface of said brake rotor while said first grinding stone is spaced apart from the first braking surface of the brake rotor;

whereby both first and second faces of said brake rotor are successively resurfaced by the respective first and second grinding stones without adjustment to the axis of rotation of the grinding stones to thereby enhance the parallelism of the resurfacing.

2. A brake rotor resurfacer according to claim 1, wherein said rotating means for rotating a brake rotor comprises a first electric motor, a shaft driven by said motor and locking means for locking a brake rotor on said shaft for rotation on said shaft.

3. A brake rotor resurfacer according to claim 2, wherein said first electric motor includes speed reducing means for reducing the speed of the shaft driven by said motor to the range of 20 to fifty rpm.

4. A brake rotor resurfacer according to claim 1, wherein said grinder rotating means rotate said grinding stones at between 1700 and 3500 rpm.

5. A brake rotor resurfacer according to claim 1, wherein said first and second grinding stones are concentrically mounted on a single rotating grinding stone shaft.

6. A brake rotor resurfacer according to claim 1, and including a compound slide table for mounting said first and second grinding stones for adjustable movement of said first and second grinding stones radially in relation to the axis or rotation of said brake rotor and for axial movement of said grinding stones successively into engagement with opposing sides of the brake rotor.

7. A brake rotor resurfacer for resurfacing the braking surface of a vehicle brake rotor while the brake rotor is demounted from the vehicle, comprising:

(a) a first electric motor;

(b) a geared motor speed reducer operatively associated with said first motor for outputting a reduced rotational speed;

(c) a driven shaft mounted for rotation at the reduced output speed of the speed reducer;

(d) means for mounting a brake rotor to be resurfaced on said driven shaft;

(e) a second electric motor:

(f) a grinder shaft mounted for being rotated by said second electric motor;

(g) first and second grinding stones rotatably mounted in a fixed and parallel plane of rotation on said grinder shaft;

(h) locking means for locking the first and second grinding stones on the grinder shaft at a distance apart from each other greater than the axial thickness of the brake rotor to be resurfaced;

(i) engagement means for selectively moving the first grinding stone against the first braking surface of said rotating brake rotor for resurfacing the first braking surface of said brake rotor while said second grinding stone is spaced apart from the second braking surface of the brake rotor, and for thereafter selectively moving the second grinding stone against the second braking surface of said rotating brake rotor for resurfacing the second braking surface of said brake rotor while said first grinding stone is spaced apart from the first braking surface of the brake rotor;

whereby both first and second faces of said brake rotor are successively resurfaced by the respective first and second grinding stones without adjustment to the axis of rotation of the grinding stones to thereby enhance the parallelism of the resurfacing.

* * * * *